US007825723B1

(12) United States Patent
Makarem

(10) Patent No.: US 7,825,723 B1
(45) Date of Patent: Nov. 2, 2010

(54) METHOD AND APPARATUS USING AN I/O DEVICE TO ELIMINATE A LEVEL SHIFTER IN LOW-VOLTAGE CMOS INTEGRATED CIRCUITS

(75) Inventor: Rabih F. Makarem, Irvine, CA (US)

(73) Assignee: Atheros Communications, Inc., San Jose, CA (US)

( * ) Notice: Subject to any disclaimer, the term of this patent is extended or adjusted under 35 U.S.C. 154(b) by 8 days.

(21) Appl. No.: 12/400,706

(22) Filed: Mar. 9, 2009

(51) Int. Cl.
*G06G 7/12* (2006.01)
*G06G 7/26* (2006.01)

(52) U.S. Cl. ..... 327/563; 327/65

(58) Field of Classification Search ..... 327/65–68, 327/560–563; 330/252–253
See application file for complete search history.

(56) References Cited

U.S. PATENT DOCUMENTS 7,119,600 B2 * 10/2006 Chen ..... 327/333
7,456,662 B2 * 11/2008 Okamura ..... 327/52
7,579,878 B2 * 8/2009 Pera ..... 327/65

* cited by examiner

*Primary Examiner*—Quan Tra
(74) *Attorney, Agent, or Firm*—GSS Law Group

(57) ABSTRACT

This discloses an integrated circuit and at least one CMOS analog circuit including a first circuit component generating an output signal received by a second circuit component to generate a feedback signal received by the first component to regulate the output signal, where the transistors of the first circuit component consist of first MOS transistor instances compliant with a first core voltage and the feedback signal requires the transistors of the second circuit component to consist of at least one second MOS transistor instance compliant with a second core voltage above the first core voltage. The CMOS analog circuit may implement an amplifier, a transconductance amplifier and/or a telescopic amplifier. The first core voltage may at most 1.2 volts and the second core voltage may be at least three volts. The first MOS transistors may be thin oxide transistors and the second MOS transistors may be thicker oxide transistors.

11 Claims, 3 Drawing Sheets

METHOD AND APPARATUS USING AN I/O DEVICE TO ELIMINATE A LEVEL SHIFTER IN LOW-VOLTAGE CMOS INTEGRATED CIRCUITS

TECHNICAL FIELD

This invention relates to analog circuits requiring feedback jeopardized by the low voltage between gate and source in CMOS transistors as found in low voltage CMOS integrated circuits, in particular, analog circuits such as transconductance amplifiers.

BACKGROUND OF THE INVENTION

Today, there is a consistent demand for lower power consumption in a wide variety of CMOS integrated circuits and many of these integrated circuits include at least one prior art CMOS analog circuit built with transistors operating at 1.2 Volts (V).

FIG. 1 shows a prior art transconductance amplifier as a Gm tuned circuit that is the one example of a prior art CMOS analog circuit built with transistors operating at 1.2 V, where Gm is a measure or estimate of the transductance of the analog circuit. Typically, the Gm tuned circuit is configured with the Gm of the input transistors set based upon Gm=Iref/DeltaV using feedback and the tail current Itail will change so that the relationship Gm=Iref/DeltaV is supported.

FIG. 2 shows a prior art example of the GM tuned circuit as a CMOS amplifier including Pmos transistors P1 and P2 and Nmos M1 and M2, as the transductor with the tail current Itail being sourced by an NMOS transistor Mb. In steady state, the transistor Mb will provide just enough tail current so that Gm=½ (Gm1+Gm2)=Iref/DeltaV and the tail current is set by the voltage between the gate and source of Mb Vgs(Mb) =V0. Thus V0 sets the tail current and it must also be large enough to keep M2 and Mb in saturation.

Consider FIGS. 1 and 2: Assume that M2 and Mb require a saturation voltage of 200 milliVolts (mV) each, implying that V0 must be at least 400 mV. Further assume that Mb is a low voltage device configured to operate at 1.2 Volts. Then its threshold voltage will likely be about 300 mV and its Voltage between gate and source (Vgs) will be anywhere from 300 mV to 500 mV depending upon the required current Itail. It is possible that Vgs(Mb) may not be enough to support proper Direct Current (DC) biasing of M2 and Mb.

The problem comes when the devices M2 and Mb each require a saturation voltage of 200 mV. If Mb is a low voltage device, operating at 1.2V for example, its threshold voltage will be about 300 mV and its Vgs will be between 300V and 500 mV depending on the required Itail across Mb. This leads to the possibility the circuit will fail because Vgs(Mb) may not enough to provide proper DC bias to M2 and Mb.

$I_{TAIL}$ is an important currant source because the current sunk by it helps to determine the overall tranconductance of the amplifier. In the implementation shown in FIG. 2, the first voltage $V_O$ may be used to bias $I_{TAIL}$ through the gate voltage $V_{gs}$ of the transistor Mb. Assuming a saturation voltage $V_{DS}$ may be about 200 mV, then $V_O$ will be around 400 mV. Note that the transistor Mb may not be operating in saturation, but rather in the "analog" region. That is, $V_{gs}>V_{TH}$, but not so great as to put Mb in saturation.

As the operating power supply voltages are pushed lower by advancing technology, the operating point $V_O$ may also be pushed lower. Like a stack of dominos, $V_O$ affects the bias of the transistor Mb, which affects transconductance and overall operation of the circuit.

For example, the problem in the prior art becomes worse in a telescopic CMOS amplifying stage as shown in FIG. 3. The amplifier of FIG. 2 has been refined to include a telescoping stage adding Nmos transistors M3 and M4. Now V0 needs to support the DC bias of 3 MOSFET transistors Mb, M2 and M4. If Mb is a 1.2 V device, then its Vgs will be less than required for $V_0$ to provide proper DC biasing to Mb, M2 and M4.

One way to solve this uses a level shifter to offset the first voltage $V_O$ to a second voltage, $V_{TH}$ of Mb. FIG. 4 shows an approach known in the prior art that employs a level shifter with a Vx across itself, so that V0=Vx+Vgs(mb) when the circuit is in equilibrium. While this works, it adds a level shifter requiring more power and has done nothing to stop leakage from M2. It also adds complexity and tends to increase the die area required when used in integrated circuits.

SUMMARY OF THE INVENTION

The invention solves this problem in an integrated circuit by including at least one CMOS analog circuit including a first circuit component generating an output signal and a second circuit component receiving the output signal to generate a feedback signal received by the first component to regulate the output signal, where the transistors of the first circuit component consist of first MOS transistor instances compliant with a first core voltage and the feedback signal requires the transistors of the second circuit component to consist of at least one second MOS transistor instance compliant with a second core voltage above the first core voltage.

The CMOS analog circuit may implement an amplifier. The amplifier may further be a transconductance amplifier. The first circuit component may form a transconductance stage. The second circuit component may be a second MOS transistor providing the feedback signal as a tail current $I_{TAIL}$ to bias the first circuit component. The amplifier may be telescopic amplifier.

Some embodiments of the invention may be implemented with the first core voltage of at most one and two tenths volts and the second core voltage of at least three volts. The first MOS transistors may be thin oxide transistors and the second MOS transistors may be thicker oxide transistors. A thick oxide transistor is generally used to drive signals off chip operating at higher voltages, like 3.3V. As such, the threshold voltage $V_{TH}$ of thick oxide devices are greater than the second transistors compliant with 1.2 volts that are commonly used in these analog CMOS circuits. This greater threshold voltage may support a voltage level shifting function to be realized while still maintaining proper bias required of the tail current $I_{TAIL}$.

Using this tail current source comprised of the second MOS transistor may create a reliable analog circuit without needing a level shifter. It may also reduce the leakage current of the analog circuit due to the threshold voltage $V_{TH}$ being greater, so the transistor may be placed in cutoff mode more reliably.

The second circuit component tail current source may consist of a PMOS transistor connected to VDD. The first circuit component may include a reference current source consisting of at least one NMOS transistor and/or at least one PMOS transistor.

DETAILED DESCRIPTION

Figure 1:
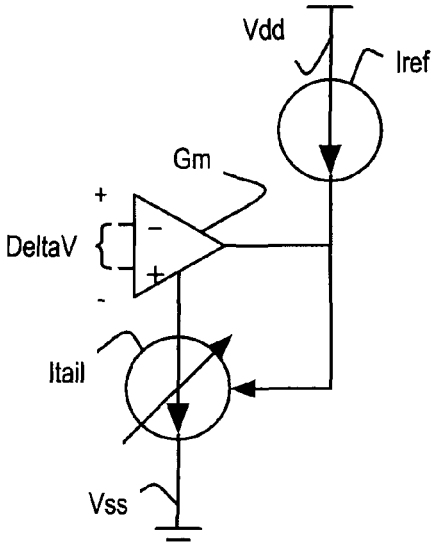
Fig. 1 Prior Art
FIG. 1 shows a prior art transconductance amplifier as a Gm tuned circuit that is the one example of a prior art CMOS analog circuit built with transistors operating at 1.2 V, where Gm is a measure or estimate of the transductance of the analog circuit.
Figure 2:
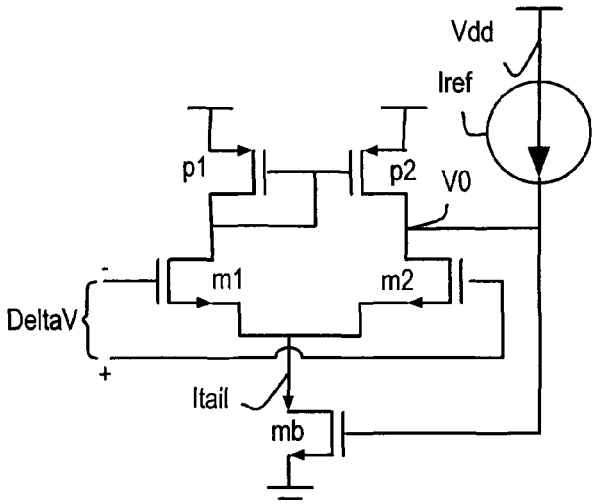
Fig. 2 Prior Art
FIG. 2 shows a prior art example of the GM tuned circuit as a CMOS amplifier including PMOS transistors P1 and P2 and NMOS M1 and M2, as the transductor with the tail current Itail being sourced by an NMOS transistor Mb. The problem comes when the devices M2 and Mb each require a saturation voltage of around 200 mV. If Mb is a low voltage device, operating at 1.2V for example, its threshold voltage will be about 300 mV and its Vgs will be between 300V and 500 mV depending on the required Itail across Mb. This leads to the possibility the circuit will fail because Vgs(Mb) may not be enough to provide proper DC bias to M2 and Mb.
Figure 3:
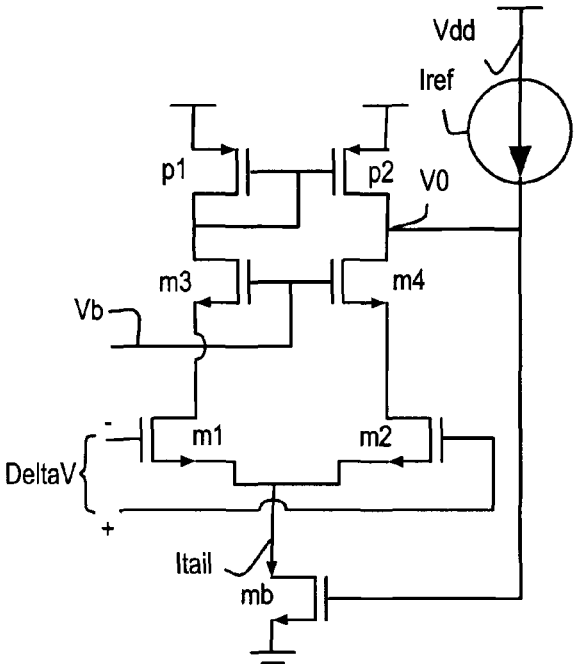
Fig. 3 Prior Art
FIG. 3 shows a prior art example of a telescopic amplifier in which the problem may actually be worse.
Figure 4:
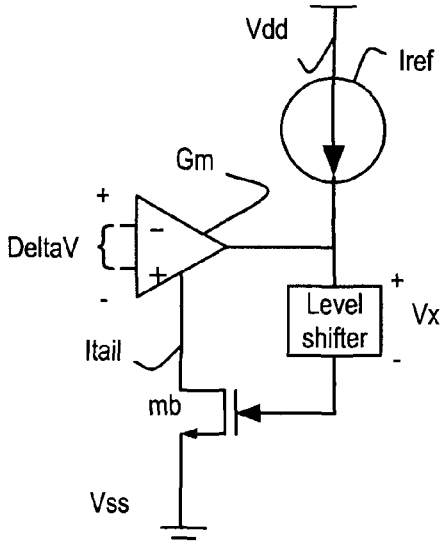
Fig. 4 Prior Art
FIG. 4 shows an approach known in the prior art that employs a level shifter with a Vx across itself, so that V0=Vx+Vgs(mb) when the circuit is in equilibrium. While this works, it adds a level shifter that requires more power and has done nothing to stop leakage from M2, adding complexity and tending to increase the die area of integrated circuits.

This invention relates to analog circuits requiring feedback jeopardized by the low voltage between gate and source in CMOS transistors as found in low voltage CMOS integrated circuits, in particular, analog circuits such as transconductance amplifiers. The invention solves this problem in an integrated circuit 30 by including at least one CMOS analog circuit 32 including a first circuit component 10 generating an output signal 4 and a second circuit component 20 receiving the output signal to generate a feedback signal 6 received by the first component to regulate the output signal, where the transistors of the first circuit component consist of first MOS transistor instances compliant with a first core voltage and the feedback signal requires the transistors of the second circuit component to consist of at least one second MOS transistor instance compliant with a second core voltage above the first core voltage.

Figure 5:
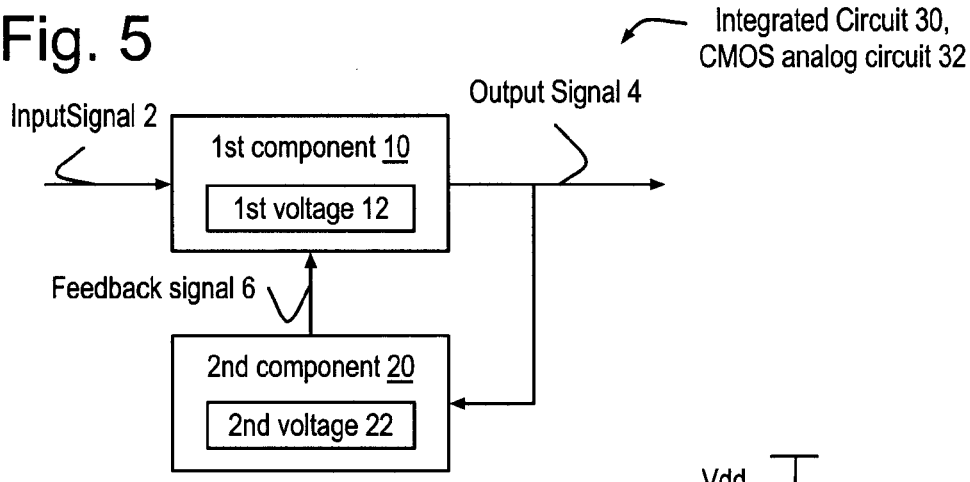
FIG. 5 shows an example embodiment of the integrated circuit including at least one CMOS analog circuit that includes an input signal presented to a first circuit component generating an output signal received by a second circuit component to create a feedback signal received by the first circuit component to regulate the output signal based upon the input signal.

Referring to the drawings more particularly by reference numbers, FIG. 5 shows an example embodiment of the integrated circuit 30 including at least one Complementary-symmetry Metal-Oxide Semiconductor (CMOS) analog circuit 32 that includes an input signal 2 presented to a first circuit component 10 generating an output signal 4 received by a second circuit component 20 to create a feedback signal 6 received by the first circuit component to regulate the output signal based upon the input signal.

Figure 6:
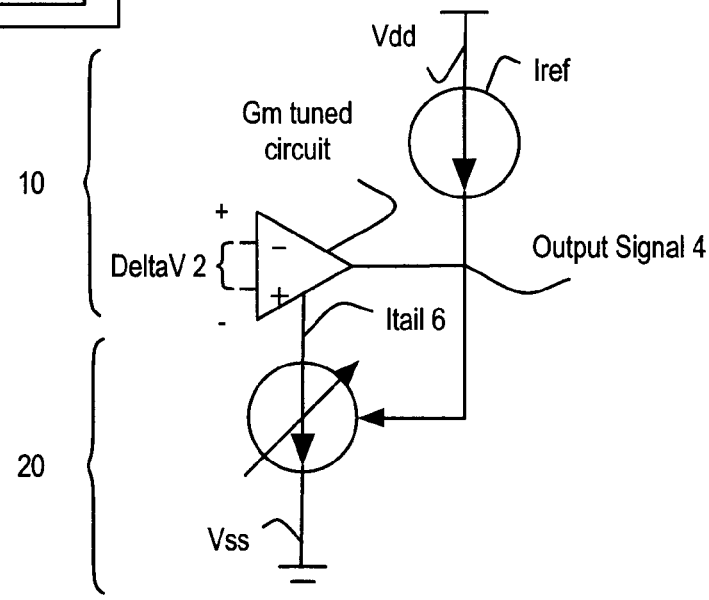
FIG. 6 shows an example embodiment of the CMOS analog circuit implementing a transconductance amplifier. The first circuit component may form a transconductance stage including first MOS transistors designed for a first core voltage and operating with the feedback signal biasing the first circuit component as a tail current $I_{TAIL}$.

FIG. 6 shows an example embodiment of the CMOS analog circuit 32 implementing a transconductance amplifier. The first circuit component 10 may form a transconductance stage including first MOS transistors designed for a first core voltage and operating with the feedback signal 6 biasing the first circuit component as a tail current $I_{TAIL}$.

Figure 7:
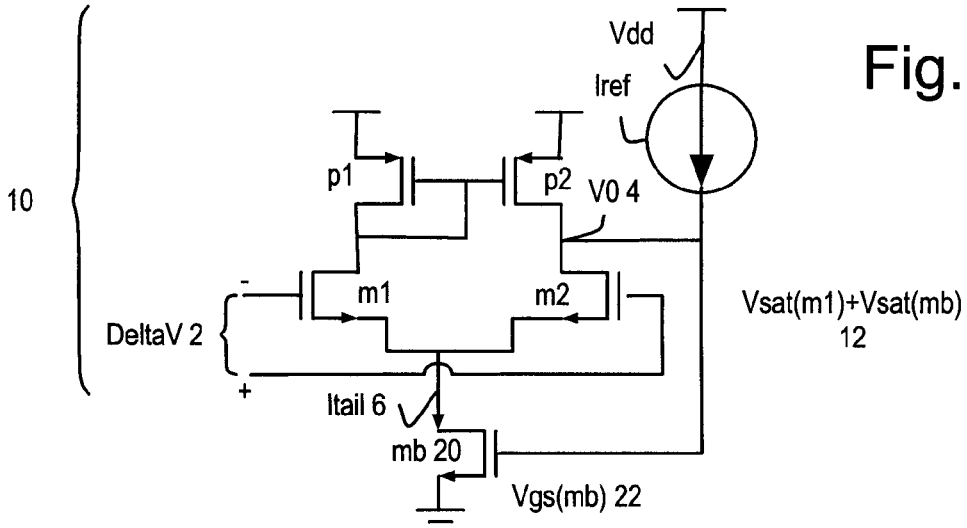
FIG. 7 shows a refinement of FIG. 6 showing the second circuit component may be a second MOS transistor mb providing the tail current $I_{TAIL}$ to the first circuit component. The first MOS transistors m1, m2, p1 and p2, as well as in the reference current source may be transistors with thin oxide and the second MOS transistor mb may be transistors with thicker oxide as shown in FIGS. 9A and 9B. The second MOS transistor may have a relatively greater $V_{TH}$ compared to the $V_{TH}$ of the first MOS transistors. The greater $V_{TH}$ may support a voltage level shifting function to be realized while still maintaining proper bias current $I_{TAIL}$.
Figure 9A:
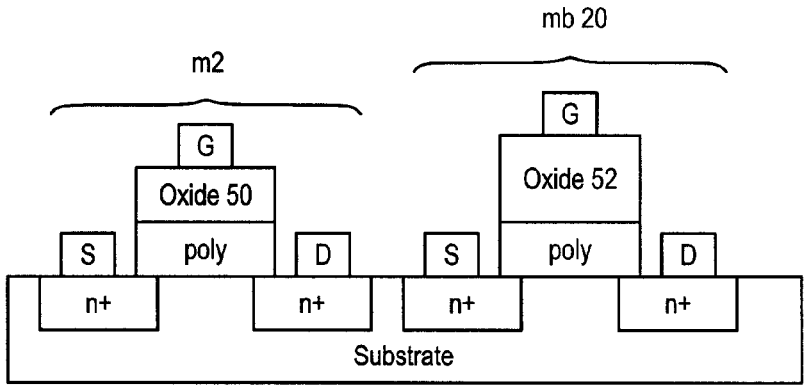
FIG. 9A shows two representative NMOS transistors, a first transistor instance with the thin oxide compliant with the first core voltage and a second transistor instance with the thicker oxide compliant with the second core voltage above the first core voltage.
Figure 9B:
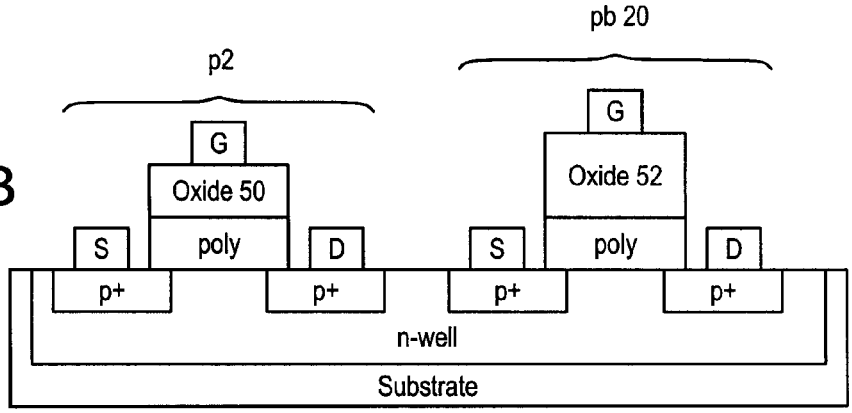
FIG. 9B shows two representative PMOS transistors, a first transistor instance with the thin oxide compliant with the first core voltage and a second transistor instance with the thicker oxide compliant with the second core voltage above the first core voltage.

FIG. 7 shows a refinement of FIG. 6 showing the second circuit component may be a second MOS transistor mb 20 providing the tail current $I_{TAIL}$ to the first circuit component. The first MOS transistors m1, m2, p1 and p2, as well as in the reference current source may be transistors with thin oxide 50 and the second MOS transistor mb may be transistors with thicker oxide 52 as shown in FIGS. 9A and 9B. The second MOS transistor may have a relatively greater $V_{TH}$ compared to the $V_{TH}$ of the first MOS transistors. The greater $V_{TH}$ may support a voltage level shifting function to be realized while still maintaining proper bias current $I_{TAIL}$.

Using this tail current source as the second MOS transistor mb with thicker oxide 52 creates a reliable analog circuit without needing a level shifter. It also reduces the leakage current of the analog circuit, since $V_{TH}$ is greater, so the FET can be placed in cutoff mode more reliably.

Figure 8:
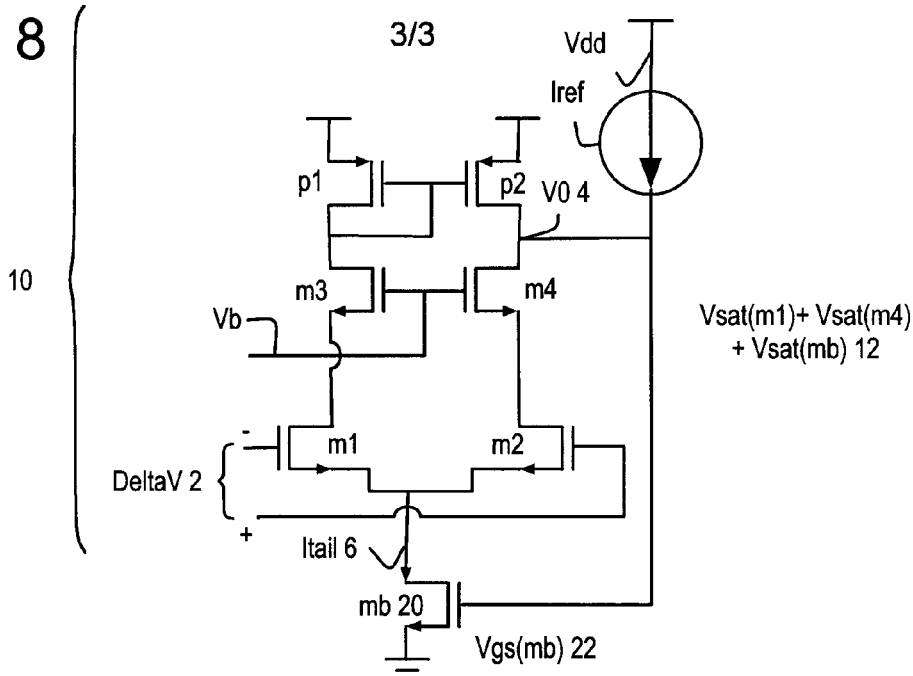
FIG. 8 shows the analog circuit component 32, may further include a telescopic amplifier.

FIG. 8 shows the analog circuit component 32, may further include a telescopic amplifier.

FIG. 9A shows two representative NMOS transistors, m2 is a first transistor instance with the thin oxide 50 compliant with the first core voltage and mb is a second transistor instance with the thicker oxide 52 compliant with the second core voltage above the first core voltage.

FIG. 9B shows two representative PMOS transistors, p2 is a first transistor instance with the thin oxide 50 compliant with the first core voltage and pb is a second transistor instance with the thicker oxide 52 compliant with the second core voltage above the first core voltage. The second circuit component may include a current source of $I_{TAIL}$ that is a PMOS transistor pb connected to VDD. The first circuit component may further include a reference current source that may either be a PMOS transistor compatible with FIGS. 7 and 8, or in the alternative, an NMOS transistor.

The preceding embodiments provide examples of the invention, and are not meant to constrain the scope of the following claims.

What is claimed is:

1. An integrated circuit, comprising:

at least one CMOS analog circuit including an amplifier generating an output based upon an input, comprising:

a first circuit component forming a transconductance stage configured to receive said input, to receive a feedback signal as a tail current Itail, and to generate said output, with said first circuit component consisting of at least two first transistor instances compliant with a first core voltage of at most one and two tenth volts; and a second circuit component configured as a current source to receive said output and generate said feedback signal as said tail current Itail requiring said second circuit component to consist of at least one second transistor instance compliant with a second core voltage of at least three volts.

2. The integrated circuit of claim 1, wherein each of said first MOS transistor instances has a first oxide thickness; and each of said second MOS transistor instances has a second oxide thickness greater than said first oxide thickness.

3. The integrated circuit of claim 1, wherein each of said first MOS transistor instances is a member of the group consisting of an NMOS device and a PMOS device.

4. The integrated circuit of claim 1, wherein each of said second MOS transistor instances is a member of the group consisting of an NMOS device and a PMOS device.

5. The integrated circuit of claim 1, wherein said transconductance amplifier further implements a telescopic amplifier.

6. An analog CMOS circuit, comprising:

an amplifier generating an output based upon an input, comprising:

a first circuit component forming a transconductance stage configured to receive said input, to receive a feedback signal as a tail current Itail, and to generate said output, with said first circuit component consisting of at least two first MOS transistor instances compliant with a first core voltage;

a second circuit component configured as a current source to receive said output and generate said feedback signal as said tail current Itail requiring said second circuit component to consist of at least one second MOS transistor instance compliant with a second core voltage above said first core voltage;

wherein each of said first MOS transistor instances has a first oxide thickness; and wherein each of said second MOS transistor instances has a second oxide thickness greater than said first oxide thickness.

7. The analog CMOS circuit of claim 6, wherein said second core voltage is at least twice said second core voltage.

8. The analog CMOS circuit of claim 7, wherein said second core voltage is at least two and nine tenths volts.

9. The analog CMOS circuit of claim 6, wherein each of said first MOS transistor instances is a member of the group consisting of an NMOS device and a PMOS device.

10. The analog CMOS circuit of claim 6, wherein each of said second MOS transistor instances is a member of the group consisting of an NMOS device and a PMOS device.

11. The analog CMOS circuit of claim 6, wherein said transconductance amplifier further implements a telescopic amplifier.

* * * * *